US007374158B2

(12) United States Patent
Deming

(10) Patent No.: US 7,374,158 B2
(45) Date of Patent: May 20, 2008

(54) MULTI-PURPOSE CLAMP

(75) Inventor: Daniel M. Deming, Winsted, CT (US)

(73) Assignee: The Stanley Works, New Britain, CT (US)

( * ) Notice: Subject to any disclaimer, the term of this patent is extended or adjusted under 35 U.S.C. 154(b) by 16 days.

(21) Appl. No.: 11/434,197

(22) Filed: May 16, 2006

(65) Prior Publication Data

US 2007/0267796 A1 Nov. 22, 2007

(51) Int. Cl.
*B25B 1/20* (2006.01)

(52) U.S. Cl. ..... 269/41; 269/236; 269/156; 269/95

(58) Field of Classification Search ..... 269/41, 269/42, 71–73, 211, 208, 235–236, 156, 95
See application file for complete search history.

(56) References Cited

U.S. PATENT DOCUMENTS

| | | | | |
|---|---|---|---|---|
| 1,498,638 | A | 6/1924 | Periolat | |
| 2,815,777 | A | 12/1957 | Iraids | |
| 4,125,251 | A | 11/1978 | Jamieson, Jr. | |
| 4,377,959 | A | 3/1983 | DeCarolis | |
| 5,143,359 | A | 9/1992 | Bush | |
| 5,172,895 | A * | 12/1992 | Klimach | 269/41 |
| 6,062,541 | A | 5/2000 | Hampton | |
| 6,079,703 | A | 6/2000 | Chavez, Jr. | |
| 6,138,999 | A | 10/2000 | Gombinsky | |
| 6,412,767 | B1 | 7/2002 | Beckmann et al. | |
| 6,435,497 | B1 | 8/2002 | Borter | |
| 6,746,006 | B2 | 6/2004 | Thomas | |
| 6,860,475 | B2 * | 3/2005 | Wong | 269/41 |
| 6,929,253 | B2 | 8/2005 | Marks | |
| 6,955,344 | B2 | 10/2005 | Brass et al. | |
| 2004/0007803 | A1 * | 1/2004 | Wong | 269/41 |
| 2006/0284358 | A1 * | 12/2006 | Ben-Gigi | 269/41 |

FOREIGN PATENT DOCUMENTS

| | | |
|---|---|---|
| DE | 3625924 A1 | 7/1986 |
| DE | 199 36 453 A1 | 8/1999 |
| FR | 2824771 | 5/2001 |

OTHER PUBLICATIONS

United Kingdom Search Report issued for United Kingdom Patent Application No. GB0709234.9, dated Aug. 24, 2007.

* cited by examiner

*Primary Examiner*—Lee D Wilson
(74) *Attorney, Agent, or Firm*—Pillsbury Winthrop Shaw Pittman, LLP

(57) ABSTRACT

The invention provides a multi-purpose reversible clamp comprising a threaded rod having a handle fixed at a first end, a lower jaw mounted on the threaded rod above the handle, the lower jaw including a female corner receiving portion facing away from the handle, wherein the uppermost portions of the female corner receiving portion include a plurality of flattened surfaces that share a common plane. The clamp also includes an upper jaw with a male corner portion on a first end and a flat surface on a second end. In a corner clamping configuration, the upper jaw is mounted on the threaded rod with the male corner portion facing the female corner receiving portion of the lower jaw. In a parallel clamping configuration, the upper jaw is mounted on the threaded rod with the flat surface facing the flattened points of the lower jaw.

19 Claims, 4 Drawing Sheets

MULTI-PURPOSE CLAMP

BACKGROUND OF THE INVENTION

1. Field of the Invention

The invention relates to a multi-purpose clamp.

2. Description of Related Art

In the realm of hand tools, there are many different types of clamps. For example, basic "C" clamps may be used in many different applications to secure two or more workpieces together. Recently, other types of clamps have become popularized, mostly because of their ease of use or their specific utility. For example, modern bar clamps can be tightened using one hand and are used in multiple industrial and building applications. Clamps with specific utility include corner clamps. Corner clamps are typically used to join two sections of material together at an angle to form the corner of a workpiece.

With the variety of different clamping needs in industrial, building, craft, or other applications, a worker may require several different types of clamps to meet his or her needs. This result may be costly, as workers may be required to purchase or rent various types of clamps, each of which may have very a narrow scope of use. As such, there exists a need and a market for multipurpose clamps that can easily be used for clamping in different configurations.

BRIEF SUMMARY OF THE INVENTION

In one embodiment of the invention, a multi-purpose reversible clamp is capable of securing, joining, or clamping material at 90 degree angles in corner, butt, or other "V" arrangements. Additionally, in some embodiments, the multi-purpose reversible clamp is capable of securing, joining, or clamping material into cross (e.g., "X" shaped) or "T" shaped arrangements.

A reversibility feature of the multi-purpose reversible clamp also enables the clamp to function as a parallel clamp which can secure, join, or clamp material in parallel arrangements. This multi-purpose clamping functionality can be enabled by an upper jaw portion of the clamp that includes a male corner feature for use in a corner clamping configuration (enabling "V," "X," or "T" arrangements) and a flat/planar surface on an end opposite to the male corner feature for use in a parallel clamping configuration. In one embodiment, the corner clamping configuration utilizes the male corner feature of the upper jaw and a female corner receiving feature of a lower jaw. The parallel clamping configuration utilizes the planar surface of the upper jaw and flattened surfaces located at the topmost portion of the lower jaw. Additionally, the reversible corner clamp can be securely mounted to a work surface via one or more mounting holes in one or more portions of the clamp.

In one embodiment, the multi-purpose reversible clamp includes a central threaded dowel or rod having a longitudinal axis. At a first end of the threaded rod is a handle. In one embodiment, the handle is fixed to the threaded rod such that rotation of the handle directly translates into rotation of the threaded rod.

Mounted on the threaded rod above the handle, is a lower jaw. The lower jaw includes a female corner receiving portion. In some embodiments, the female corner receiving portion includes two perpendicularly arranged arms. Each of the arms include respective inner surfaces that are orthogonal to one another. This configuration enables the female corner receiving portion of the lower jaw to secure two materials (for example, two pieces of wood or other material) at a 90 degree relationship with one another.

In one embodiment, each of the two arms include upper flattened surfaces. The two upper flattened surfaces face away from the handle and are spaced apart according to the spacing/configuration of the two arms. The two spaced flattened surfaces both exist on a common plane that defines a first additional clamping surface. The common plane of the first additional clamping surface is perpendicular to the longitudinal axis of the threaded rod when the lower jaw is mounted on the threaded rod.

In one embodiment, the reversible corner clamp includes an upper jaw. In one embodiment, the upper jaw includes a male corner portion on a first end and a flat/planar surface on a second end opposite from the first end. In some embodiments, the upper jaw is mounted on the threaded rod with the male corner portion facing the lower jaw. This may be referred to as a corner clamping configuration. The male corner portion comprises two outer surfaces, which are disposed orthogonally to one another (i.e., the male corner portion forms a 90 degree angle). As such, the 90 degree angle formed by the male corner portion of the upper jaw matches up with and generally fits into the 90 degree angle formed by the female corner receiving portion of the lower jaw. The upper jaw can be moved towards or away from the lower jaw. Material (e.g., a corner workpiece) may be placed into and secured, joined, or clamped into 90 degree corner or butt arrangements between the 90 degree angle formed by the male corner portion of the upper jaw and the 90 degree angle formed by the female corner receiving portion of the lower jaw.

In some embodiments, the lower jaw includes two gaps or channels that define the planes of the inner surfaces of the female corner receiving portion and the outer surfaces of the male corner portion past the vertex of the planes of said surfaces. These gaps or channels enable material that is placed between the lower jaw and the upper jaw to reach past the vertex of these planes. This enables joining and/or clamping in cross (e.g., "X" shaped) or "T" shaped arrangements when the upper jaw is mounted in the corner clamping configuration (i.e., with the male corner portion facing the lower jaw).

In some embodiments, the upper jaw is mounted on the threaded rod with the planar surface of the upper jaw facing towards the lower jaw. This is referred to as the parallel clamping configuration. When mounted in the parallel clamping configuration, the planar surface of the upper jaw defines a second additional clamping surface. In the parallel clamping configuration, the second additional clamping surface of the upper jaw is parallel with the first additional clamping surface of the lower jaw. The parallel clamping configuration enables materials to be placed and secured, joined, or clamped between the facing flat surfaces of the lower jaw and the upper jaw.

In one embodiment, the multi-purpose reversible clamp may also include one or more mounting holes for securing it to another structure, a work surface, a tool, a workpiece, or other item. In one embodiment, an axis of the one or more of mounting holes is perpendicular to longitudinal axis of the threaded dowel. In one embodiment, the mounting holes may be disposed completely through the lower jaw so that a fastener such as, for example, a screw, a nail, a brad, a rivet, or other fastener may be inserted into the mounting holes and secured into the work surface, tool, or other item.

These and other objects, features, and advantages of the invention will be apparent through the detailed description of the preferred embodiments and the drawings attached hereto. It is also to be understood that both the foregoing summary and the following detailed description are exemplary and not restrictive of the scope of the invention.

DETAILED DESCRIPTION OF THE INVENTION

The invention provides a multi-purpose reversible clamp. The clamp enables securing, joining, or clamping of material at 90 degree angles in corner, butt, or other "V" arrangements. In some embodiments, the clamp also enables securing, joining, or clamping material into cross (e.g., "X" shaped) or "T" shaped arrangements.

In one embodiment, a reversibility feature of the clamp enables a corner clamp function as well as a parallel clamp function which can secure, join, or clamp material in parallel arrangements. This multi-purpose clamping functionality can be enabled by an upper jaw portion of the clamp that includes a male corner feature for use in a corner clamping configuration (e.g., enabling "V," "X," or "T" arrangements) and a flat/planar surface on the upper jaw opposite the male corner feature for use in a parallel clamping configuration. In one embodiment, the corner clamping configurations utilize the male corner feature of the upper jaw and a female corner receiving feature of a lower jaw. The parallel clamping configuration utilizes the planar surface of the upper jaw and spaced flattened surfaces located at the topmost portion of the lower jaw. Additionally, the multi-purpose reversible clamp can be securely mounted to a work surface via one or more mounting holes in one or more portions of the clamp.

Figure 1:
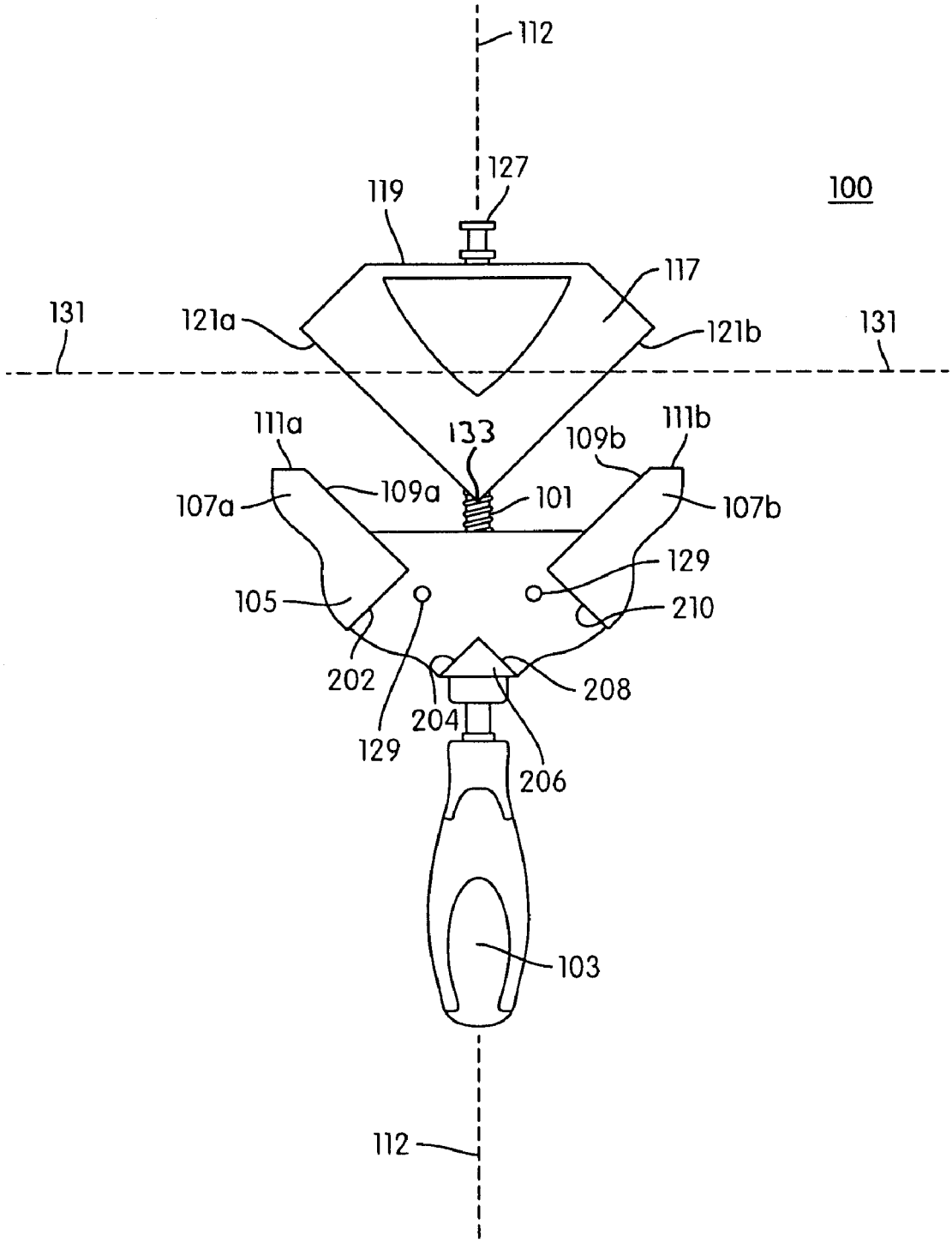
FIG. 1 illustrates a multi-purpose reversible corner clamp in a corner clamping configuration, according to an embodiment of the invention.

FIG. 1 illustrates a multi-purpose reversible clamp 100, according to an embodiment of the invention. In one embodiment, multi-purpose reversible clamp 100 comprises a central threaded dowel or rod 101 having a longitudinal axis 112. At a first end of threaded rod 101 is a handle 103. In one embodiment, handle 103 is molded from plastic material. Optionally, handle 103 may include a gripping surface such as, for example, an overmolded rubber material surface contoured for a worker's hand. Other materials and/or shapes may be used for handle 103. In one embodiment, handle 103 is fixed to threaded rod 101 such that rotation of handle 103 directly translates into rotation of threaded rod 101. Handle 103 may enable stabilization of threaded rod 101 while one or more other components of corner clamp 100 are moved in relation to threaded rod 101 (for example, threaded onto or off of threaded rod 101) or may enable rotation of threaded rod 101 in relation to one or more other components of reversible corner clamp 100 (for example, tightening jaw portions together for clamping).

Figure 2:
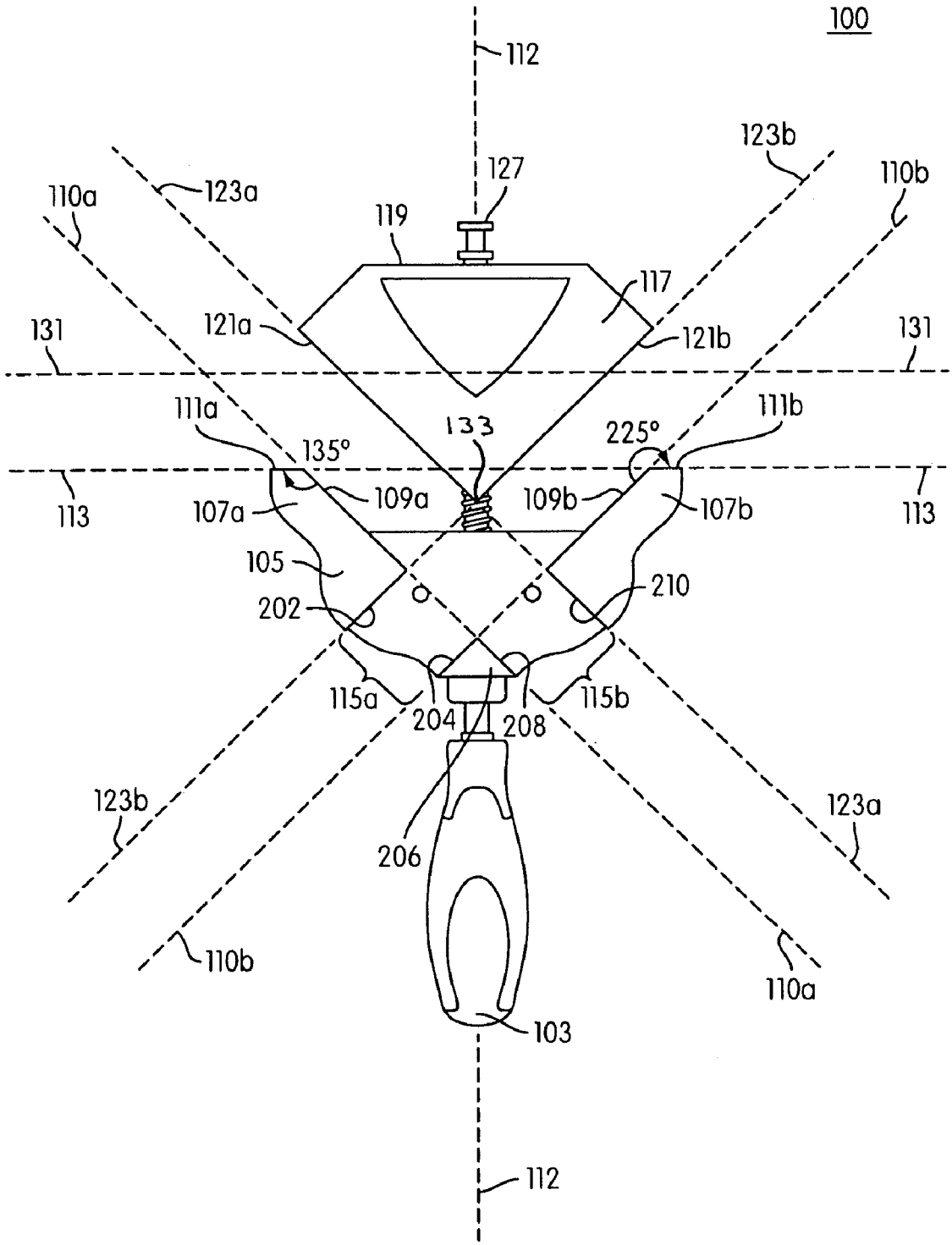
FIG. 2 illustrates a multi-purpose reversible corner clamp in a corner clamping configuration, according to an embodiment of the invention.

Mounted on threaded rod 101 above handle 103 is a first jaw 105. In one embodiment, first jaw 105 may be considered a "lower jaw." First jaw 105 includes a female corner receiving portion. In some embodiments, the female corner receiving portion comprises two perpendicularly arranged arms 107*a* and 107*b*. Each of arms 107*a* and 107*b* include an inner surface 109*a* and 109*b*, respectively. FIG. 2 illustrates that the plane 110*a* of inner surface 109*a* is perpendicular to the plane 110*b* of inner surface 109*b* (e.g., inner surface 109*a* and 109*b* are arranged orthogonally). As such, surfaces 109*a* and 109*b* form a first pair of orthogonally arranged surfaces. This configuration enables the female corner receiving portion of first jaw 105 to position materials comprising a workpiece into a 90 degree relationship with one another. When these materials are positioned in the female corner receiving portion of first jaw 105 at a 90 degree relationship, inner surfaces 109*a* and 109*b* engage workpiece surfaces that meet to form the outer corner portion of a corner workpiece.

At the top of arms 107*a* and 107*b* are flattened portions 111*a* and 111*b*, respectively. Flattened portions 111*a* and 111*b* comprise flat surfaces that face away from handle 103 and that are spaced apart according to the configuration/spacing of arms 107*a* and 107*b*. Flattened portions 111*a* and 111*b* both exist on a common plane 113. FIG. 2 illustrates the fact that plane 113 of flattened portions 111*a* and 111*b* is generally orthogonal to longitudinal axis 112 of threaded rod 101. Common plane 113 illustrates a first additional clamping surface or clamping plane that is comprised of flattened portions 111*a* and 111*b*. This first additional clamping surface (which in the disclosed embodiment comprises two spaced portions, but in an alternative embodiment, may comprise only one) may be used for, inter alia, a parallel clamping configuration, as described below.

In one embodiment, plane 113 of flattened portions 111*a* and 111*b* is orthogonal to longitudinal axis 112 and surfaces 109*a* and 109*b* are disposed orthogonally to one another. Thus, flattened portion 111*b* forms a 225 degree external angle with inner surface 109*b* (see FIG. 2). As such, the angle internal to arm 107*b* may equal 135 degrees as shown. Similarly flattened point 111*a* forms a 225 degree external angle with inner surface 109*a*, and the angle internal to arm 107*a* may equal 135 degrees as illustrated in FIG. 2. Other angular combinations may be used to achieve similar functionality.

In some embodiments, first jaw 105 is vertically fixed with respect to threaded rod 101 such that first jaw 105 does not move vertically in relation to threaded rod 101. In some embodiments, first jaw 105 is freely rotatable around threaded rod 101 (i.e., threaded rod 101 is freely rotatable within a bore running through first jaw 105). This rotation may be enabled, for example, via a bearing disposed between first jaw 105 and threaded rod 101. This rotation may enable the plane of first jaw 105 to be held stable as handle 103 is used to turn threaded rod 101 within first jaw 105 (e.g., when tightening a movable second jaw to clamp material between the movable second jaw and first jaw 105).

In some embodiments, first jaw 105 may move vertically in relation to threaded rod 101. In these embodiments, the threads of threaded rod 101 may interact with corresponding threads on a threaded central bore (not illustrated) in first jaw 105 such that relative rotational movement between threaded rod 101 and first jaw 105 may translate into relative vertical movement between first jaw 105 and threaded rod 101 (e.g., towards or away from handle 103). In some embodiments, this vertical movement may enable clamping of material between first jaw 105 and a second jaw (e.g., second jaw 117) in corner, parallel or other configurations.

Multi-purpose reversible clamp 100 also includes a second jaw 117. In one embodiment, second jaw 117 is an "upper jaw." In one embodiment, second jaw 117 includes a male corner portion on a first end and a flat/planar surface 119 on a second end opposite from the first end. The male corner portion comprises a second pair of orthogonally arranged surfaces 121*a* and 121*b*, which are disposed orthogonally from one another. As such, planes 123*a* and 123*b* of surfaces 121*a* and 121*b* are perpendicular to each other, as illustrated in FIG. 2.

In some embodiments, planar surface 119 may be considered to be a second additional clamping surface. In some embodiments, this second additional clamping surface may be used for, inter alia, parallel clamping, as discussed below. In some embodiments, the additional clamping surface 119 may face a direction toward surfaces 111*a* and 111*b* while simultaneously providing the surfaces 121*a* and 121*b* (for clamping surfaces forming the inner corner of a corner workpiece) in an orientation facing outer corner workpiece engaging surfaces 109*a* and 109*b*. For example, rather than forming a lower point 133, upper jaw 117 may have a flattened lower surface.

In one embodiment, second jaw 117 is mounted on threaded rod 101 via a threaded central bore (not illustrated) disposed through second jaw 117. The main axis of the threaded central bore runs parallel to the main plane of movable upper jaw 117. When second jaw 117 is mounted onto threaded rod 101, the threaded central bore and threaded rod 101 share the same axis (e.g., longitudinal axis 112). In some embodiments, when mounted on threaded rod 101, second jaw 117 maybe moved vertically with respect to threaded rod 101 by rotating second jaw 117 and threaded rod 101 relative to one another (e.g., rotating second jaw 117 around threaded rod 101 or by turning handle 103, causing threaded rod 101 to rotate within the threaded central bore of second jaw 117).

In one embodiment, when second jaw 117 is mounted on threaded rod 101 via the threaded central bore of second jaw 117, relative rotational movement between threaded rod 101 and second jaw 117 translates into relative vertical movement between threaded rod 101 and second jaw 117. This is because of the nature and interaction of the threads on both the threaded central bore and threaded rod 101. For example, in one instance, threaded rod 101 may include male threads disposed in a spiral fashion along part or all of its length. Similarly, the threaded central bore may include matching female threads. As such, these interacting threads are able to translate relative rotational movement between threaded rod 101 and the threaded central bore into relative vertical or transverse movement between threaded rod 101 and second jaw 117 (e.g., second jaw 117 moves along threaded rod 101 towards or away from first jaw 105). This translation from rotational to vertical movement using threads may be similar to that of a male machine screw being inserted into a threaded female screw receptacle. The vertical or transverse movement of second jaw 117 along threaded rod 101 towards or away from first jaw 105 enables placement and clamping of material between second jaw 117 and first jaw 105 in corner, parallel, or other configurations.

In some embodiments, second jaw 117 is mounted on threaded rod 101 with the male corner portion facing first jaw 105 (flat surface 119 facing away from first jaw 105). This first relative position of first jaw 105 to second jaw 117, wherein the first pair of orthogonally arranged surfaces (i.e., surfaces 109*a* and 109*b* of the female receiving portion of first jaw 105) face the second pair of orthogonally arranged surfaces (i.e., surfaces 121*a* and 121*b* of the male corner portion of second jaw 117) may be referred to as a corner clamping configuration. In the corner clamping configuration, the spacing between second jaw 117 and first jaw 105 may be changed by moving second jaw 117 towards first jaw 105. This enables a user to clamp a corner workpiece between the male corner portion of second jaw 117 and the female corner receiving portion of first jaw 105.

A user may cause second jaw 117 to move towards first jaw 105 for clamping purposes by grasping handle 103 with one hand and rotating handle 103 (thus, causing threaded rod 101 to rotate), while ensuring that second jaw 117 does not rotate (thus, drawing second jaw 117 along threaded rod 101 towards first jaw 105). Other methods may be used to achieve similar relative movements. In another embodiment, wherein first jaw 105 is vertically movable relative to threaded rod 101, rotation of handle 103 may cause first jaw 105 to move along rod 101 towards second jaw 117, which may remain vertically fixed.

In the corner clamping configuration, surfaces 109*a* and 109*b* of first jaw 105 engage the surfaces defining the outer corner of a workpiece being clamped in a corner configuration. Also, surfaces 121*a* and 121*b* of second jaw 117 engage the surfaces of a corner workpiece defining the inner corner of the workpiece being clamped in a corner configuration. As such, multi-purpose clamp 100 enables material to be clamped into 90 degree corner arrangements (e.g., two pieces ending in 45 degree angles or other complementary angles) or butt arrangements. FIGS. 1-2 illustrate second jaw 117 mounted in the corner clamping configuration.

In some embodiments, first jaw 105 includes two lower channels 115*a* and 115*b*. Channel 115*a* is formed by a lower surface 202 formed on a lower side of arm 107*a* and a surface 204 formed on a lower central portion 206 of first jaw 105. In one embodiment, surface 202 and surface 204 are disposed parallel to one another and are disposed at a fixed distance relative to one another. This distance, in one embodiment, equals approximately 2 inches, making channel 115*a* suitable for receiving a "2×4" depthwise. However, other distances for other sizes/types of workpieces is contemplated. In one embodiment, the distance between surfaces 202 and 204 may be adjustable. For example, arm 107*a* may be adjustably fixed closer or further from lower central portion 206. In another example, the distance between surface 202 and 204 may be adjusted by placing an insert, defining a channel with a different width inside channel 115*a*. Other methods of adjusting channel width may be used.

In addition, lower central portion 206 (which in one embodiment, has a triangle configuration) includes another surface 208 that cooperates with a lower surface 210 on arm 107*b* to define channel 115*b*. In one embodiment, surfaces 208 and 210 are disposed parallel to one another and also disposed at a fixed distance to receive a particular size/type of workpiece, such as being spaced by 2 inches to receive a "2×4" depthwise. However, other distances for other sizes/types of workpieces is contemplated. In one embodiment, the distance between surfaces 208 and 210 may be adjustable. For example, arm 107*b* may be adjustably fixed closer or further from lower central portion 206. In another example, the distance between surface 208 and 210 may be adjusted by placing an insert, defining a channel with a different width inside channel 115*b*. Other methods of adjusting channel width may be used.

Channel 115*a* can be considered to be a continuation of the channel formed between surface 121*b* of second jaw 117 and the surface 109*b* of first jaw 105 when multi-purpose reversible clamp 100 is in the corner clamping configuration (illustrated in FIGS. 1 and 2). Similarly, channel 115*b* can be considered to be a continuation of the channel formed between surface 121*a* of second jaw 117 and surface 109*a* of first jaw 105 when multi-purpose reversible clamp 100 is in the corner clamping configuration.

As illustrated in FIG. 2, channels 115*a* and 115*b* further define planes 110*a* and 110*b* past their intersection with one another and further define planes 123*a* and 123*b* past their intersection with one another. As such, material of a workpiece that is placed in the female corner receiving portion of first jaw 105 may continue through channels 115*a* and or 115*b* past the vertex of planes 110*a* and 110*b* (which, in the embodiment illustrated in FIG. 2, occurs at the upper tip of lower central portion 206). This enables joining and/or clamping in cross (e.g., "X" shaped) and "T" shaped arrangements when second jaw 117 is mounted on threaded rod 101 in the corner clamping configuration (e.g., with the male corner portion facing first jaw 105).

Figure 3:
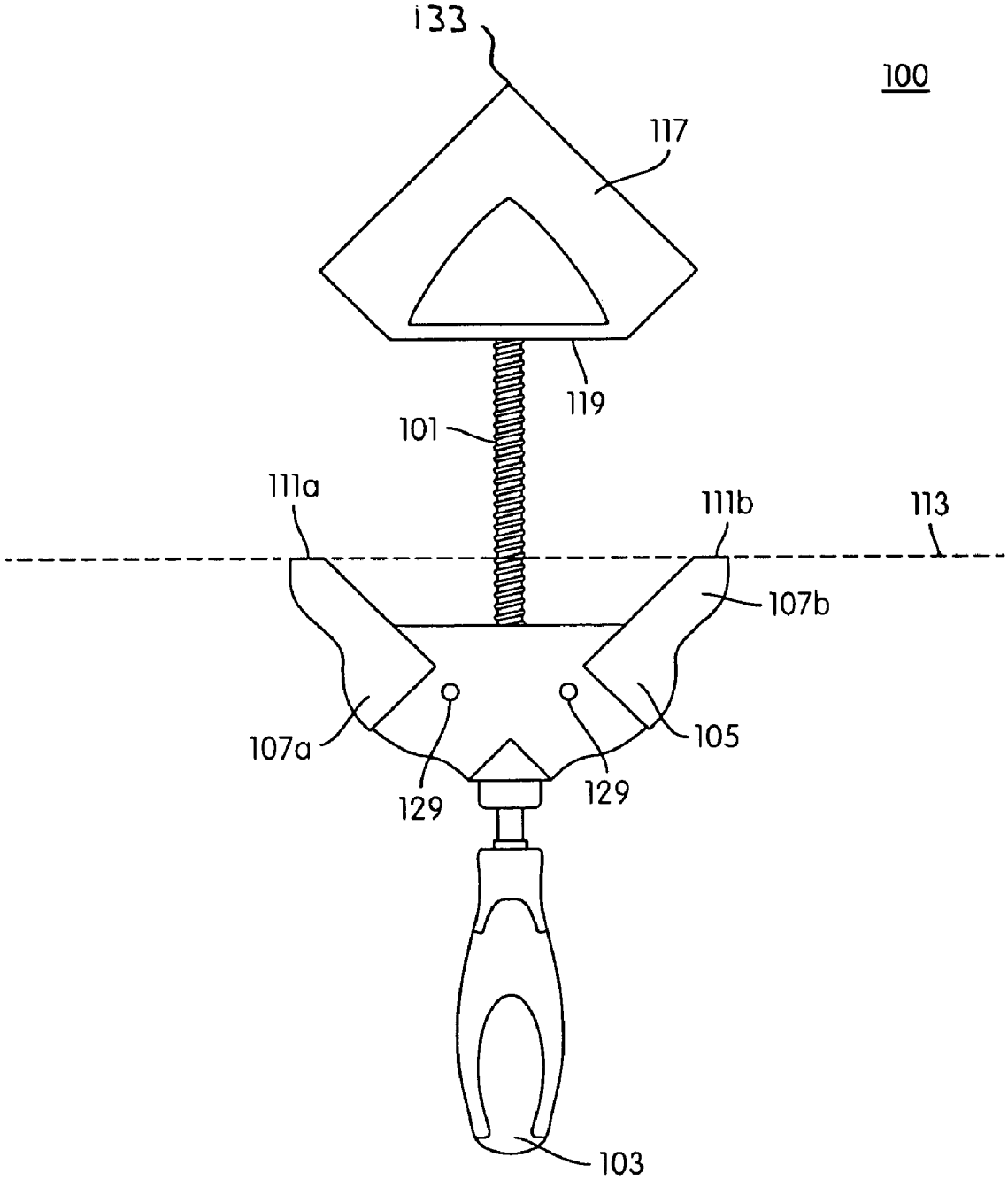
FIG. 3 illustrates a multi-purpose reversible corner clamp in a parallel clamping configuration, according to an embodiment of the invention.

In some embodiments, second jaw 117 is mounted on threaded rod 101 with planar surface 119 of second jaw 117 facing towards both handle 103 and first jaw 105. This second relative position of first jaw 105 and second jaw 117, wherein the first additional clamping surface (formed by flattened surfaces 111*a* and 111*b* of first jaw 105) and the second additional clamping surface (in this embodiment, surface 119 of second jaw 117) face one another is referred to as the parallel clamping configuration. When mounted in the parallel clamping configuration, planar surface 119 is facing towards handle 103 and fixed lower jaw 105, as illustrated in FIG. 3. As such, the second additional clamping surface formed by planar surface 119 is generally parallel to the first additional clamping surface formed by flattened surfaces 111*a* and 111*b* and is generally perpendicular to longitudinal axis 112 of threaded rod 101.

The parallel clamping configuration enables a workpiece to be clamped in a parallel fashion between first jaw 105 and second jaw 117. First, the workpiece is placed between first jaw 105 and second jaw 117. The spacing between first jaw 105 and second jaw 117 may then be changed by moving one of first jaw 105 or second jaw 117 closer to the other. In one embodiment, second jaw 117 is moved toward first jaw 105. This may be accomplished, for example, by a user grasping and rotating handle 103, which causes threaded rod 101 to rotate within the threaded bore of second jaw 117 (while the user prevents similar rotation of second jaw 117). This relative rotation of threaded rod 101 inside second jaw 117 draws second jaw 117 toward first jaw 105, which remains vertically fixed relative to rod 101. Other methods may be used to achieve similar relative motion, achieving the same result.

In another embodiment wherein first jaw 105 is vertically movable relative to threaded rod 101, rotation of handle 103 may cause first jaw 105 to move along rod 101 towards second jaw 117, which remains vertically fixed.

As second jaw 117 is moved towards first jaw 105, a first surface of the workpiece is engaged by flattened surfaces 111*a* and 111*b* (i.e., the first additional clamping surface) and a second surface of the workpiece is engaged by planar surface 119 (i.e., the second additional clamping surface).

Figure 4:
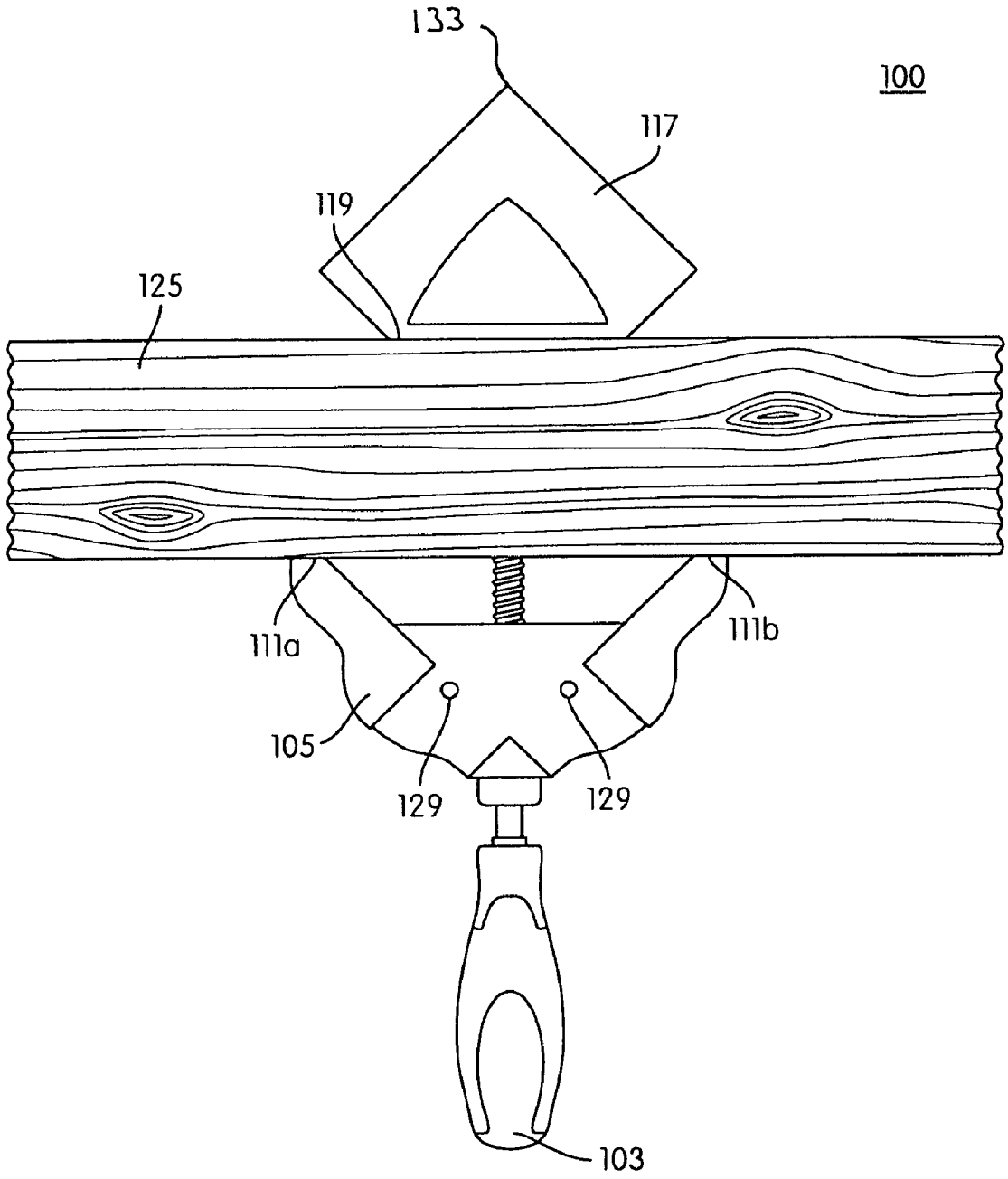
FIG. 4 illustrates a multi-purpose reversible corner clamp and a piece of material in a parallel clamping configuration, according to an embodiment of the invention.

As illustrated in FIG. 4, the parallel clamping configuration enables multi-purpose reversible clamp 100 to secure workpiece 125 in a parallel fashion. In some embodiments, workpiece 125 may comprise two or more pieces of material that may be clamped, secured, or joined together in a parallel fashion using multi-purpose reversible clamp 100.

Multi-purpose reversible clamp 100 may be changed from the corner clamping configuration of FIGS. 1 and 2 to the parallel clamping configuration of FIGS. 3 and 4. In one embodiment, second jaw 117 may be moved away from fixed lower jaw 105 until movable upper jaw 117 is no longer mounted on threaded rod 101. This may be accomplished by rotating second jaw 117 relative to threaded rod 101 (e.g., by rotating handle 103, causing threaded rod 101 to rotate within the threaded bore of second jaw 117, or by rotating second jaw 117 around threaded rod 101) in a direction that causes the second jaw 117 to move away from first jaw 105. When second jaw 117 has reached the end of threaded rod 101, a user may grasp second jaw 117 and remove it completely from threaded rod 101. In some embodiments, multi-purpose reversible clamp 100 may include a removable cap 127 on the top of threaded dowel 101. In these embodiments, cap 127 is removed before removing movable upper jaw 117 from threaded dowel 101.

Once removed from threaded rod 101, the user may rotate second jaw 117 180 degrees, on an axis perpendicular to longitudinal axis 112 of threaded rod 101, so that planar surface 119 faces first jaw 105. The user may then remount second jaw 117 onto threaded rod 101 by placing threaded rod 101 into the portion of the threaded central bore of second jaw 117 that exists on the end of second jaw 117 having planar surface 119. Second jaw 117 may then be moved toward first jaw 105 by rotating second jaw 117 relative to threaded rod 101 in a manner that draws second jaw 117 towards first jaw 105. For example, this may be accomplished by a user turning handle 103 with his or her hand, which causes threaded rod 101 to rotate within the threaded central bore of second jaw 117. This may also be accomplished by rotating second jaw 117 around threaded rod 101.

Reversible corner clamp 100 may also be switched from a parallel clamping configuration to a corner clamping configuration in a similar manner as that described herein for switching from a corner clamping configuration to a parallel clamping configuration (e.g., removing second jaw 117, rotating it 180 degrees and remounting).

In one embodiment, as noted above, the male corner portion of second jaw 117 may have a flattened tip rather than pointed tip 133. FIGS. 1 and 2 illustrate a plane 131 running across the male corner portion of second jaw 117. The flattened tip may be formed by a flat surface existing where plane 131 crosses second jaw 117. In this embodiment, the triangular tip portion of second jaw 117 below plane 131 would not exist. In some embodiments, the flattened tip of the male corner portion of second jaw 117 may be utilized as the second additional clamping surface. Because the flattened tip of second jaw 117 may be parallel to the first additional clamping surface (formed by flattened tips 111*a* and 111*b*, defined by plane 113), reversible corner clamp 100 may be used to clamp materials in a parallel configuration while the male corner portion of second jaw 117 is facing first jaw 105. That is, material may be clamped in a parallel configuration wherein flattened points 111*a* and 111*b* (i.e., the first additional clamping surface) engage a first surface of a workpiece and the flattened point of second jaw 117 (i.e., in this embodiment, the second additional clamping surface) engage a second surface of the workpiece. In some embodiments, plane 131 defining the flattened tip of the male corner portion of second jaw 117 may be higher or lower along second jaw 117, thus forming a longer or shorter second additional clamping surface.

In one embodiment, multi-purpose reversible clamp 100 may include one or more mounting holes 129 for securing multi-purpose reversible clamp 100 to a structure, workpiece, work surface, tool, or other item. FIGS. 1, 3 and 4 illustrate two mounting holes 129 in fixed lower jaw 105. In one embodiment, an axis of one or more of mounting holes 129 is perpendicular to longitudinal axis 112 of threaded rod 101. In one embodiment, mounting holes 129 may be disposed completely through first jaw 105 so that a fastener such as, for example, a screw, a nail, a brad, a rivet, or other fastener may be inserted through mounting holes 129 and into a work surface, tool, or other item. Securing multi-purpose reversible clamp 100 may serve to stabilize and otherwise facilitate easier clamping, joining, or other operations accomplished by multi-purpose reversible clamp 100.

In some embodiments, one or more of first jaw 105, second jaw 117, handle 103, and/or other elements of multi-purpose reversible clamp 100 may be manufactured from molded, extruded, or otherwise-manufactured plastic. Other materials (e.g., metals, polymers, wood, etc.) may be used to manufacture first jaw 105, second jaw 117, handle 103, and/or other elements of multi-purpose reversible clamp 100. In some embodiments, handle 103 may include additional grip elements made of rubber, foam or other material that provides a comfortable and/or secure gripping surface for the hand of a user. In some embodiments, threaded rod 101, threaded removable cap 127, and/or other elements of multi-purpose reversible clamp 100 may be manufactured from steel or other metal. Other materials (e.g., other plastics, polymers, wood, etc.) may also be used to manufacture threaded rod 101, threaded removable cap 127, and/or other elements of multi-purpose reversible clamp 100.

While the invention has been described with reference to the certain illustrated embodiments, the words that have been used herein are words of description, rather than words of limitation. Changes may be made, within the purview of the associated claims, without departing from the scope and spirit of the invention in its aspects. Although the invention has been described herein with reference to particular structures, acts, and materials, the invention is not to be limited to the particulars disclosed, but rather can be embodied in a wide variety of forms, some of which may be quite different from those of the disclosed embodiments, and extends to all equivalent structures, acts, and, materials, such as are within the scope of the associated claims.

What is claimed is:

1. A multi-purpose reversible clamp comprising:

a threaded rod, said rod having a longitudinal axis;

a handle coupled to the rod at an end of the rod;

a first jaw mounted on said rod, said first jaw including a first pair of orthogonally arranged surfaces that engage workpiece surfaces that form an outer corner of a corner workpiece, said first jaw having at least one additional clamping surface in a plane generally orthogonal to said longitudinal axis of said rod; and a second jaw mounted on said rod, said second jaw including a second pair of orthogonally arranged surfaces that engage workpiece surfaces that form an inner corner of the corner workpiece, said second jaw having an engagement portion that cooperates with said at least one additional clamping surface for clamping opposite sides of a workpiece therebetween, wherein said engagement portion faces away from said handle when said first pair of orthogonally arranged surfaces engage workpiece surfaces forming the outer corner of the corner workpiece and the second pair of orthogonally arranged surfaces engage workpiece surfaces forming the inner corner of the corner workpiece so as to clamp the corner workpiece therebetween, and wherein said second jaw is rearrangeable on the rod so that the engagement portion thereof faces toward the handle to facilitate engagement of a workpiece between the at least one additional clamping surface of the first jaw and the engagement portion of the second law;

said handle being rotatable to change a spacing between said first and second jaws to thereby clamp and release workpieces therebetween.

2. The clamp of claim 1, wherein said engagement portion of said second jaw comprises a planar surface provided on said second jaw.

3. The clamp of claim 1, wherein said engagement portion is perpendicular to said longitudinal axis of said rod.

4. The clamp of claim 1, wherein said at least one additional surface is parallel to the engagement portion.

5. The clamp of claim 1, wherein said first jaw comprises a pair of perpendicularly arranged arms, forming the first pair of orthogonally arranged surfaces, and wherein the at least one additional clamping surface comprises a pair of spaced surfaces, each formed on the end of a respective one of said arms.

6. The clamp of claim 1, wherein a relative orientation of said first and second jaws mounted on said rod can be altered between a first relative position wherein the first pair of orthogonally arranged surfaces face the second pair of orthogonally arranged surfaces, and a second relative position wherein at least one additional clamping surface of the first jaw and the engagement portion of the second jaw face one another.

7. The clamp of claim 1, wherein the first jaw is axially stationary relative to the handle, and wherein the second jaw moves axially relative to the handle upon rotation of the handle.

8. The clamp of claim 1, wherein the second jaw has a threaded bore for receiving the threaded rod.

9. The clamp of claim 1, wherein the at least one additional clamping surface forms a 135 degree angle internal to the first jaw relative to each of the surfaces of the first pair of orthogonally arranged surfaces.

10. The clamp of claim 1, wherein the at least one additional clamping surface forms a 225 degree angle external to the first jaw relative to each of the surfaces of the first pair of orthogonally arranged surfaces.

11. The clamp of claim 1, further comprising one or more mounting holes disposed through the first jaw for securing the clamp to another structure or workpiece, wherein an axis of the one or more mounting holes is perpendicular to the longitudinal axis of the rod.

12. The clamp of claim 1, wherein the handle is fixed to a first end of the rod such that rotation of the handle is directly translated into rotation of the rod.

13. The clamp of claim 1, wherein the first jaw is mounted on the threaded rod such that the threaded rod rotates within with the first jaw.

14. The clamp of claim 13, wherein the first jaw is mounted on the threaded rod via a bearing.

15. The clamp of claim 1, wherein the second jaw is mounted on the threaded rod through a threaded central bore disposed through the first jaw, wherein a main axis of the threaded central bore is parallel with the longitudinal axis of the threaded rod.

16. The clamp of claim 1, wherein the first jaw further comprises:

a lower central portion defining first and second lower channel surfaces which are orthogonally oriented with one another; and third and fourth lower channel surfaces that are orthogonally oriented with one another, wherein the first and third lower channel surfaces are parallel with one another and spaced apart by a first distance to form a first lower channel, wherein the second and fourth lower channel surfaces are parallel with one another and spaced apart by a second distance form a second lower channel, and wherein the first and second lower channels allow additional material of the corner workpiece to extend past the vertex of the planes formed by the first pair of orthogonally arranged surfaces.

17. The clamp of claim 16, wherein the first distance of the first lower channel and the second distance of the second lower channel are adjustable.

18. The clamp of claim 16, wherein the additional material of the corner workpiece enables the corner workpiece to form one or more of an "X" configuration and a "T" configuration.

19. A multi-purpose reversible clamp, comprising:

a rod having a longitudinal axis;

a first jaw mounted on the rod and defining a first pair of orthogonally arranged surfaces that engage surfaces that form an outer corner of a workpiece, said first jaw having at least a first additional clamping surface;

a second jaw mounted on the rod and defining a second pair of orthogonally arranged surfaces that engage surfaces that form an inner corner of the workpiece, said second jaw having at least a second additional clamping surface on a side of the second law opposite from the second pair of orthogonally arranged surfaces, wherein a relative orientation between the first jaw and the second jaw on the rod can be changed between a corner clamping configuration wherein the first and second pair of orthogonally arranged surfaces face one another to clamp a corner workpiece therebetween and a parallel clamping configuration wherein said first and second additional clamping surfaces are positioned in parallel facing relationship to one another.

* * * * *